US008021505B2

(12) United States Patent
Lewis

(10) Patent No.: US 8,021,505 B2
(45) Date of Patent: Sep. 20, 2011

(54) DRYWALL JOINT COMPOUND APPLICATOR FOR SEAM AND PATCH SURFACING

(75) Inventor: James Lewis, Uwchland, PA (US)

(73) Assignee: The Wall Doctorx, LLC, Uwchland, PA (US)

( * ) Notice: Subject to any disclaimer, the term of this patent is extended or adjusted under 35 U.S.C. 154(b) by 428 days.

(21) Appl. No.: 12/124,618

(22) Filed: May 21, 2008

(65) Prior Publication Data

US 2009/0288755 A1 Nov. 26, 2009

(51) Int. Cl.

| | |
|---|---|
| ***B32B 43/00*** | (2006.01) |
| ***E04F 13/02*** | (2006.01) |
| ***E04F 13/07*** | (2006.01) |
| ***B29C 73/02*** | (2006.01) |
| ***B29C 73/10*** | (2006.01) |
| ***B29C 73/14*** | (2006.01) |

(52) U.S. Cl. ..... 156/71; 156/94; 428/63; 52/514; 52/514.5

(58) Field of Classification Search ..... 156/71, 156/94; 428/41.7, 41.8, 63, 131, 134, 138, 428/139, 343, 350, 355 N, 355 R; 52/514, 52/514.5, 741.4, 741.41, 746.1

See application file for complete search history.

(56) References Cited

U.S. PATENT DOCUMENTS

| | | | | |
|---|---|---|---|---|
| 4,776,906 | A | 10/1988 | Bernard | |
| 6,627,292 | B1 | 9/2003 | Hoffmann, Sr. | |
| 7,303,802 | B1 | 12/2007 | Brower et al. | |
| 7,380,382 | B2 * | 6/2008 | Hansen | 52/514 |
| 2003/0134074 | A1 * | 7/2003 | Scolaro et al. | 428/40.1 |
| 2005/0031860 | A1 * | 2/2005 | Okada et al. | 428/354 |
| 2006/0191237 | A1 | 8/2006 | Hansen | |
| 2008/0115443 | A1 * | 5/2008 | Hathaway | 52/514 |

FOREIGN PATENT DOCUMENTS

WO WO 2007053900 A1 * 5/2007

* cited by examiner

*Primary Examiner* — Philip Tucker
*Assistant Examiner* — Sing P Chan
(74) *Attorney, Agent, or Firm* — Gregory J. Gore & Associates

(57) ABSTRACT

A drywall patch is coated with a premeasured amount of joint compound in its wet state making it immediately available for application to a wall surface. The patch with compound is sealed in an airtight wrapper or between unsealed wrapper halves which are in turn sealed in a surrounding airtight package so that the joint compound stays moist and will not harden over time. The wrapper includes a peel-away adhesive dry patch. In use, the dry patch is first applied over a crack or hole to be repaired. The wrapper and compound are applied directly over the dry patch and, while the wrapper remains in place, pressure is applied to smooth the compound over the patch and removed after the compound has dried. The wrapper is preferably composed of microporous breathable plastic film.

1 Claim, 8 Drawing Sheets

18
12
8
9
19
16
19
3
PEEL OPEN
13
17
11
18
3

3 PULL
13
2 PRESS HERE
7

13
14
11
18
17
13
11
13

FIG.12
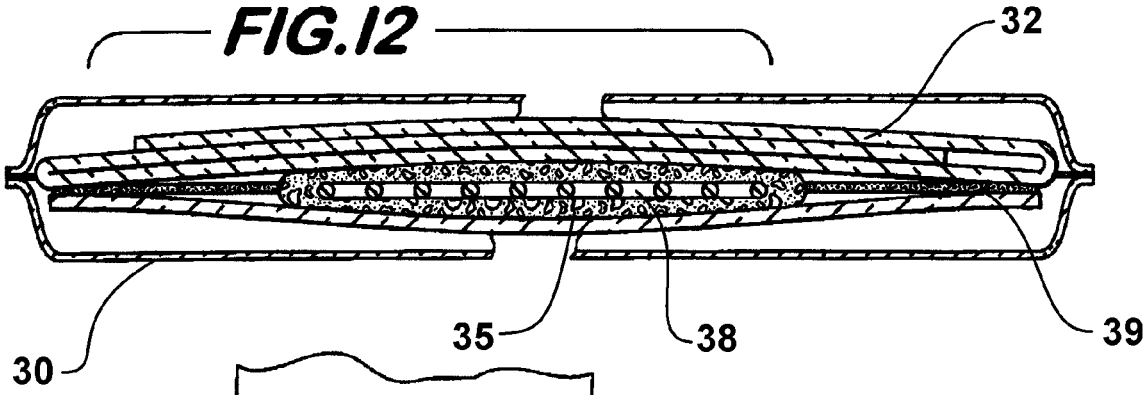
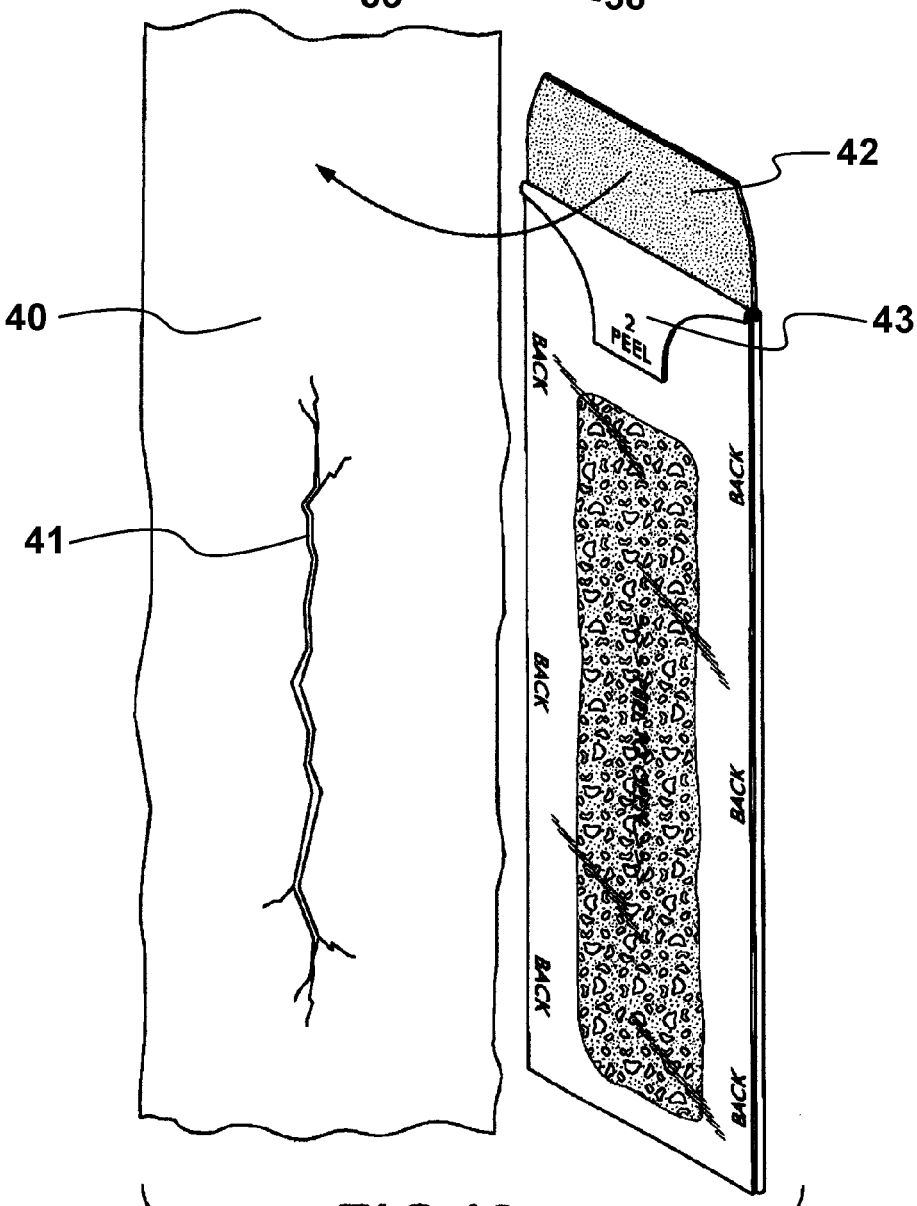
FIG.13

DRYWALL JOINT COMPOUND APPLICATOR FOR SEAM AND PATCH SURFACING

FIELD OF THE INVENTION

The invention relates to wall and ceiling surface repair and materials. In particular, it relates to a repair patch for plaster or drywall surfaces which includes a patch and settable joint compound.

BACKGROUND OF THE INVENTION AND PRIOR ART

There are known various surface wall or ceiling surface repair systems that utilize a patch. These patches, however, require the handling of sticky, messy drywall compound and specialized knowledge and tools. Compound is measured, mixed, scooped and troweled over the patch and dries to a hardened surface, then it can be sanded smooth and flush with the surrounding wall. U.S. Patent Publication 2006/0191237, titled Drywall Repair Patch, discloses a repair patch which is pre-coated with a dry, water-hardenable cement product attached to one side of a porous substrate. While this joint repair compound is delivered with the patch substrate in place, it must be wetted and troweled smooth in the same manner as the commonly used tape and compound system. Therefore, this patch does not avoid direct contact with the messy and sticky joint compound and requires special troweling tools. There is therefore a need in the art for a drywall or plaster repair patch which provides a no-touch system of applying joint compound and which does not require expertise or special tools.

SUMMARY OF THE INVENTION

In order to meet the needs in the art described above, the present drywall repair system has been devised. In its most general form, the invention provides a novel method of applying, spreading and drying a wet, settable compound such as drywall joint compound. The applicant has found that by applying a flexible, breathable sheet against the settable compound and then pressing the sheet forcibly against the application surface such as a wall or a ceiling with the compound in between, it will provide a no-touch system of applying the compound. The sheet provides a clean, mess-free surface with contour protection while drying. With the sheet in place, the compound is left to air-dry and, once dry, the sheet is peeled away from the compound. A translucent sheet of microporous "breathable" polyethelene or polypropylene film, such as MicroPro™ breathable plastic film sold by Clopay Corporation, 8585 Duke Boulevard, Mason, Ohio 45040, has been found to be particularly advantageous.

According to one embodiment of the invention, each patch is coated with a pre-measured amount of joint compound in its wet state, making it immediately available for application to the wall surface. The patch and compound combination is sealed in an airtight wrapper, or between unsealed wrapper halves which are in turn sealed in a surrounding airtight package, so that the joint compound stays moist and will not harden over time. The wrapper includes a peel-away adhesive dry patch over which the compound is to be applied. In use, the dry patch is first peeled from the wrapper and applied over a crack or hole to be repaired. Thereafter, one half of a two-part wrapper is peeled away, revealing a pre-measured amount of compound centered on an opposite half of the wrapper. The remaining wrapper half and compound are applied directly over the dry patch. While the wrapper remains in place, pressure is applied to smooth the compound over the dry patch.

Any smoothing device, such as a roller or straight-edge or even the user's hand, may be used to apply the smoothing pressure to the wrapper to spread the compound. If a transparent material is used for the wrapper, the progress of the spreading of the compound can be observed as pressure is applied in different amounts and in different directions. When the compound has been applied smoothly and evenly across both the dry-patch surface and the surrounding application surfaces, the covering wrapper material is then peeled away and discarded. The joint compound is then left to dry in the usual manner, unless a wrapper of breathable material is used, in which case the compound is left to dry with the wrapper in place before it is removed. As a final step in the smoothing process, a damp sponge or a light sandpaper may be used to feather the edges of the compound to provide a continuous surface over the repaired area. For this purpose, the outside surface of the wrapper may include a grit covering to be used for final sanding.

Thus, it will be fully appreciated that the invention provides a no-touch wall repair system which is easy to use, requires no special tools or expertise, keeps waste material to a minimum and easily disposable. While the aforementioned patch is convenient for small cracks and holes in walls or ceilings of wallboard and plastered surfaces, an alternate embodiment of the invention provides a patch system of greater surface area for repairing larger or longer cracks or for seam joint surfacing. This alternate system is similar in concept to the system described above except that the patch substrate may be-embedded within or lay behind the compound rather than being separate and first applied over the crack. According to this alternate system, an elongate length of wrapped, wet compound is vertically hung against a wall and then the underside half of face-to-face wrapping material is pulled away so that the joint compound or adhesive tape may directly contact the wall surface. The opposite side of the wrapper material includes a folded portion which may be unfolded to provide a broad covering sheet over the compound as it is spread by pressing against the sheet. As mentioned before, the substrate patch in this embodiment, preferably a self-adhesive mesh-like screen or paper tape, is embedded within the joint compound or lays behind it, and extends longitudinally, aligned with the length of the wrapper. With the wrapper unfolded, pressure is applied to the outside of the wrapper material as in the previous embodiment and likewise the underlying joint compound is spread evenly across the damaged area or seam edge until it exists as a very thin coating. The wrapper is then peeled away and the compound and patch substrate allowed to dry in place or, as described above, the process is slightly changed if a breathable wrapper is used. As with the previous embodiment, finishing feathering of the dry compound is achieved with a damp sponge or light sandpaper.

More specifically, the delivery system of the invention for wall repair compound comprises a flexible, transportable wrapper comprising a first and a second half, both halves being opposite facing, and a quantity of wet, settable compound bounded by said first and second wrapper halves and lying therebetween. The wrapper halves may be sealed along their peripheral edges by an adhesive to provide an airtight seal for the settable compound. If the wrapper halves are unsealed, the settable compound may be provided in a sealed atmosphere by encasing the wrappers and the materials in an outer airtight package. The wrapper halves may be composed of a breathable material and be either transparent or translucent. The settable compound may be any type of settable compound such as drywall joint compound. In general, the method for utilizing the invention employs a method for spreading and drying a wet, settable compound comprising the steps of applying a flexible, breathable sheet against settable compound; pressing the sheet forcibly against the compound so that it spreads laterally between an opposite side of the sheet and an application surface; air-drying the compound; and, finally, removing the sheet from the compound.

Thus, the present invention simplifies the traditional multi-step system by eliminating the need for special tools and eliminating the need for special skills and knowledge to effect drywall joint surfacing or repairing. As well as simplifying the process, the present invention reduces mess and cleanup time. Other objects and advantages of the invention will be apparent to those of skill in the art from the following drawings and description of the preferred embodiment.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 12 is a top plan sectional view taken from FIG. 10 as shown in that figure.

FIG. 13 is a top right rear view of the invention shown being directed to application over a crack to be repaired.

DESCRIPTION OF THE PREFERRED EMBODIMENT

Figures 1, 2, 3, 4:
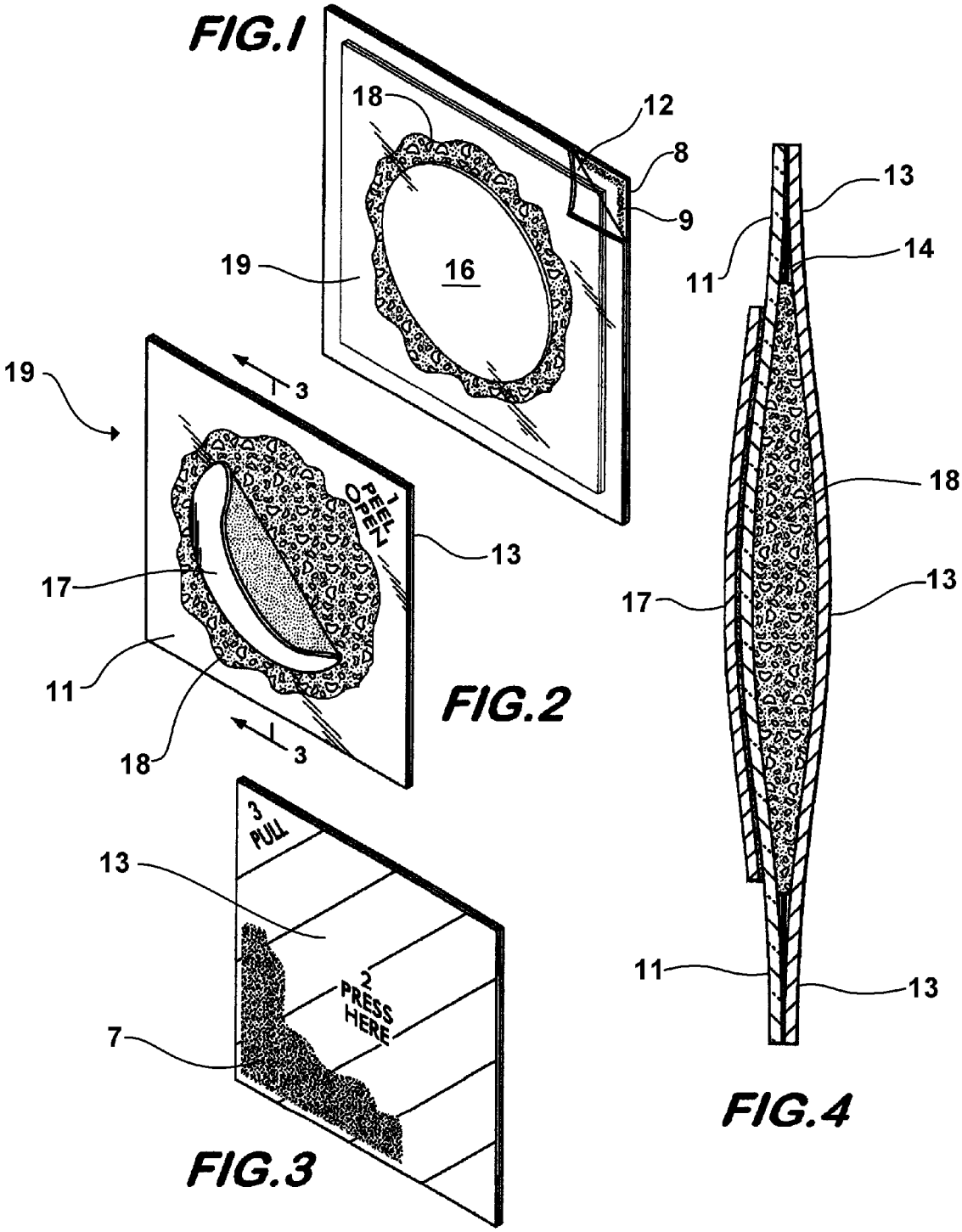
FIG. 1 is a top right front isometric view of the invention shown in a sealed, transparent package.
FIG. 2 is a top right front isometric view of the invention shown removed from the package and including a front-facing, transparent wrapper half.
FIG. 3 is a top left rear view of the invention in its state as shown in FIG. 2.
FIG. 4 is a right side elevation view taken from FIG. 2 as shown in that figure.

Referring now to FIG. 1, the wall-repair compound delivery system of the invention comprises an outer airtight packaging 16, shown in this embodiment by opposing sheets 12 and 8, sealed around the edge by adhesive 9. In this embodiment the operative components 19 are shown with a transparent front sheet in this airtight packaging which ensures that compound 18 is prevented from drying out and remains wet. The first step in using the invention is to peel open the packaging and dispose of it.

Referring now to FIG. 2, the operative constituents of the invention 19 comprise four basic elements: A peel-apart wrapper, consisting of a front half 11 and an opposing rear half 13, a quantity of settable compound such as wallboard joint compound 18 therebetween, and a self-adhesive dry patch 17 fixed to the outside of the front wrapper half. As shown in this embodiment, the front wrapper half 11 is transparent. As shown in FIG. 3, the rear wrapper half 13 is non-transparent and includes instructions for its use. It may also include a grit texture 7 to be used as a sanding implement for the final finishing step.

FIG. 4 shows the wrapper consisting of front half 11 and rear half 13, which in one embodiment are sealed around their peripheral edges by an adhesive 14. This keeps the settable compound 18 from being dried out in the event that the enclosing packaging shown in FIG. 1 is not employed. As shown in this figure, the dry patch 17 is applied to the outside surface of the front half of the wrapper 11.

Figure 5:
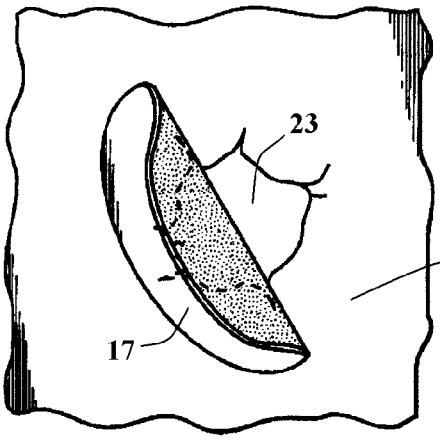
FIG. 5 is a front view of the invention showing application of the dry patch.
Figure 6:
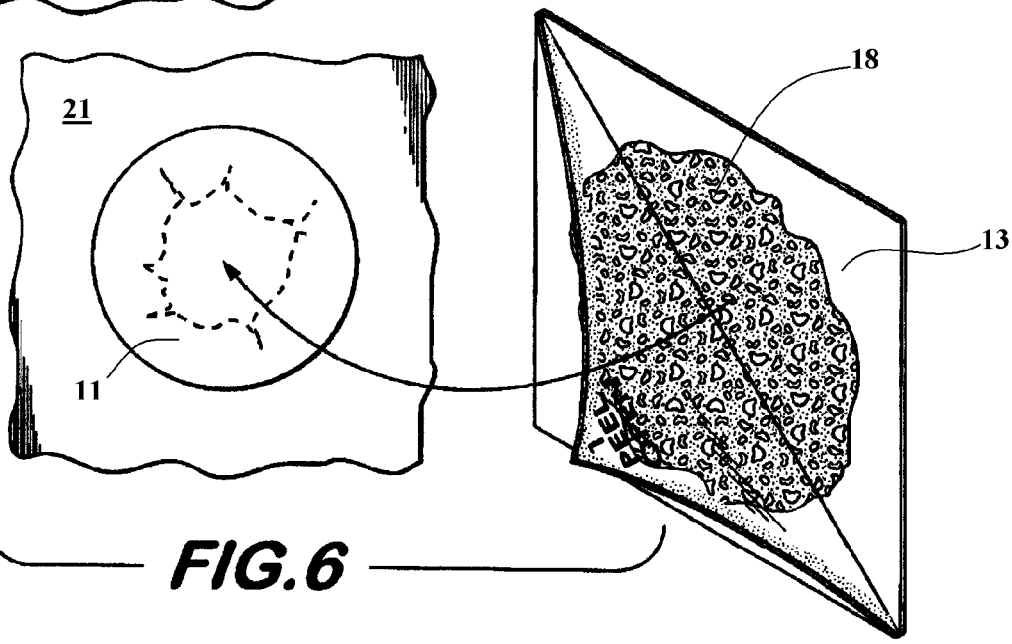
FIG. 6 is a top right front isometric view of the invention directed to application over the applied dried patch.
Figure 7:
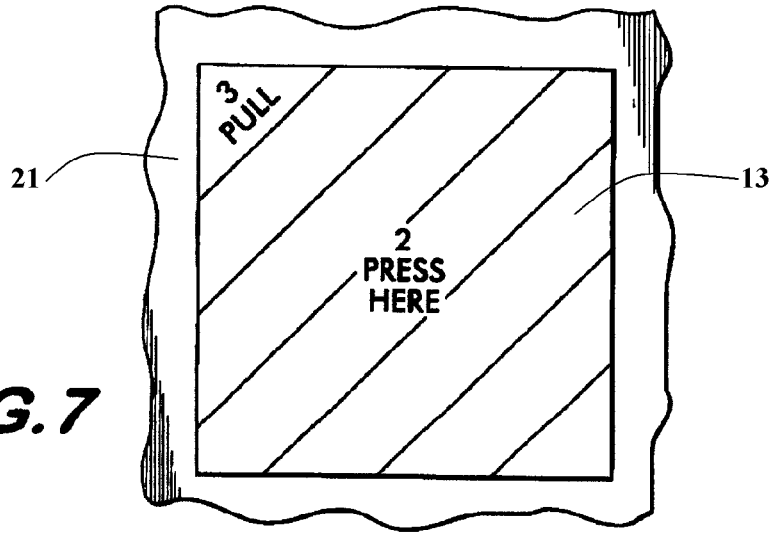
FIG. 7 is a rear elevation view of the invention after its application shown in FIG. 6.
Figure 8:
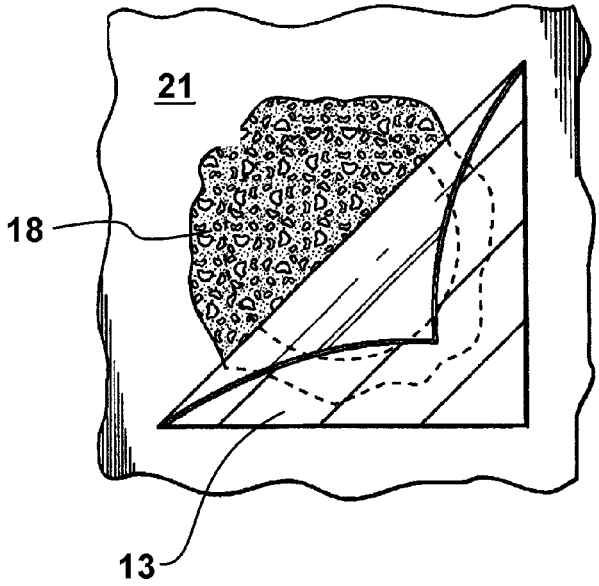
FIG. 8 is a front view showing the final step of removing the rear wrapper half.

Referring now to FIGS. 5, 6, 7 and 8, the sequence of using the invention is depicted. The first step, as shown in FIG. 5, is to remove the dry patch 17 from the wrapper and apply it to the surface to be repaired 21 over the damaged area 23. The next step, as shown in FIG. 6, is to peel away the front half of the wrapper 11, exposing the compound 18 which remains on the inside surface back half of the wrapper 13. With the back half of the wrapper still in place, the exposed compound is applied directly over the patch 17 which has been adhered to the wall 21 in the first step. The back half of the wrapper 13 as shown in FIG. 7, then faces the user and, by pressing on the wrapper, the compound underneath the wrapper can be spread and smoothed over the patch and surrounding wall surface. If a breathable material is used for the rear sheet half of the wrapper, it is permitted to dry in place. A microporous polyethelene or polypropylene film such as MicroPro™ breathable plastic film sold by Clopay Corporation, 8585 Duke Boulevard, Mason, Ohio 45040, is a suitable breathable material. If non-breathable wrapper material is employed, it is first peeled away as shown in FIG. 8 to allow air to reach the compound so that it dries with the wrapper removed. In either case, once the compound has dried the compound is then ready for final finishing. The grit texture surface 7 on the back side of the wrapper as shown in FIG. 3 may conveniently be used for this purpose. It will therefore be readily appreciated that this process provides a "no touch" application of the compound to the wall in order to repair its damaged surface.

Figure 9:
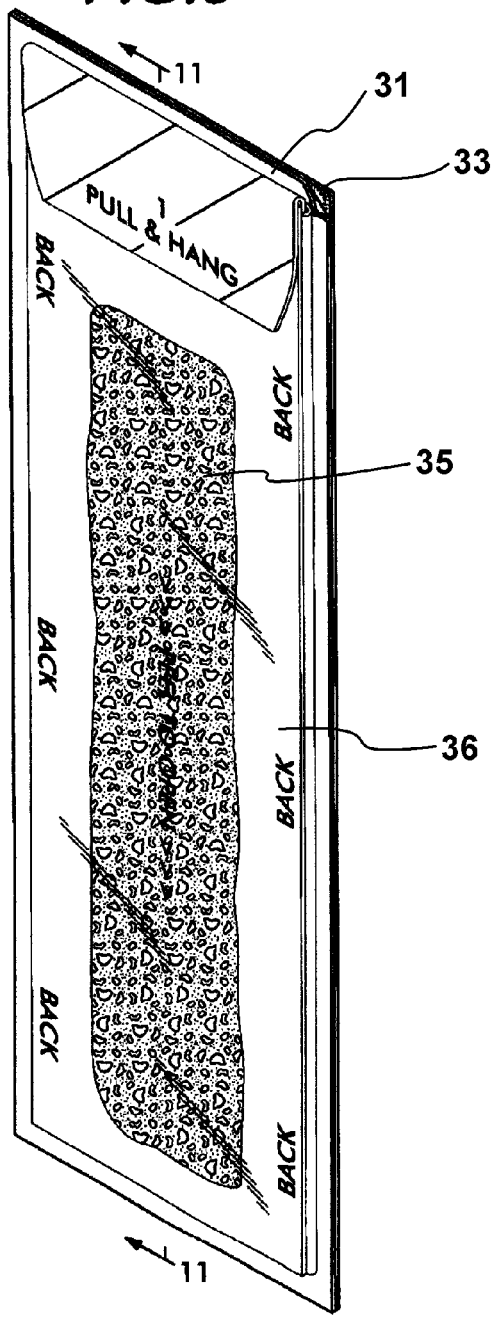
FIG. 9 is a top right front isometric view of an alternate embodiment of the invention shown sealed in a transparent package.

Referring now to FIG. 9, an alternate embodiment of the invention is shown for primary seam surfacing or larger damaged areas. Like the first embodiment, this embodiment may include an enclosing outer packaging comprising adhesively adhered opposing sheets 31 and 33. The packaging encloses operative elements of the invention which include a quantity of settable compound 35 encased in a wrapper 36.

Figure 10:
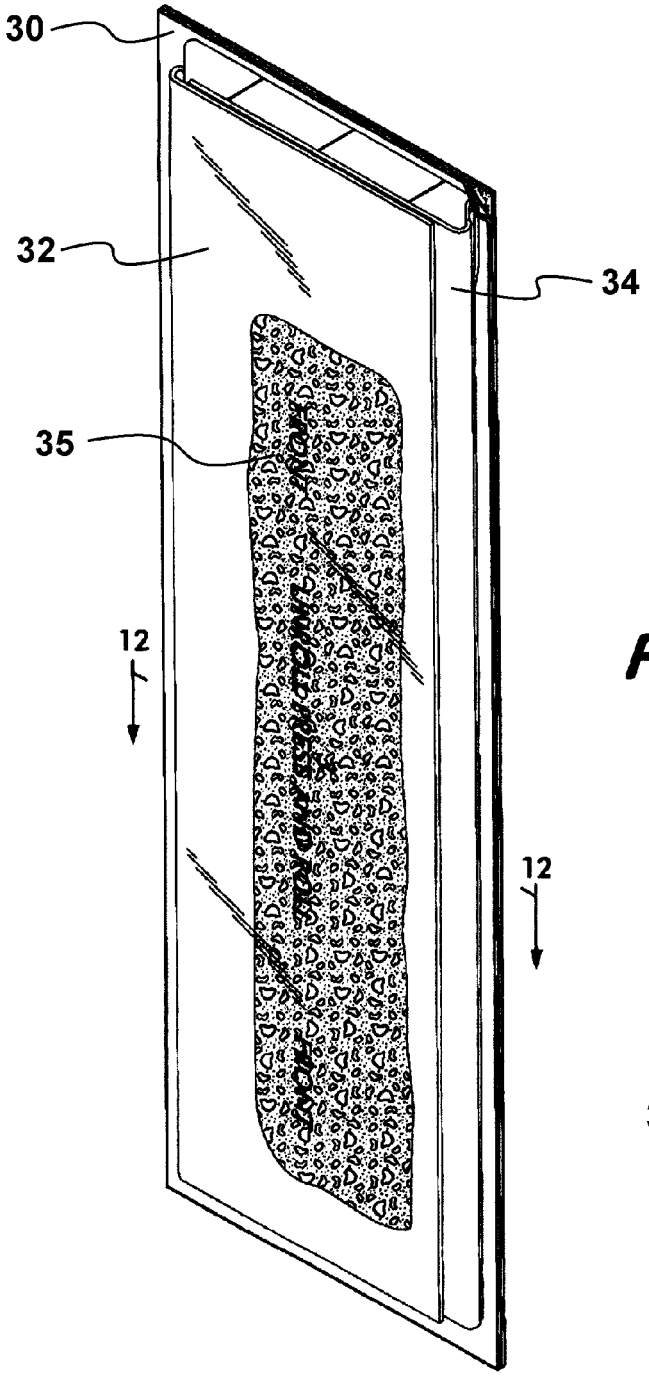
FIG. 10 is a top right front isometric view of the invention shown removed from the package.

Referring now to FIG. 10, the ensemble of FIG. 9 is shown, but from the front view. In this embodiment, a tri-fold transparent wrapper is utilized to allow for compact packaging and larger surface area for the spread of a greater amount of settable compound needed for larger repairs. The material includes an outer fold 32 and an inner fold 34. In this embodiment, the wrapper is transparent. Therefore, the settable compound 35 may be seen from this view. As previously stated, all of the operative components are sealed within packaging 30.

Figure 11:
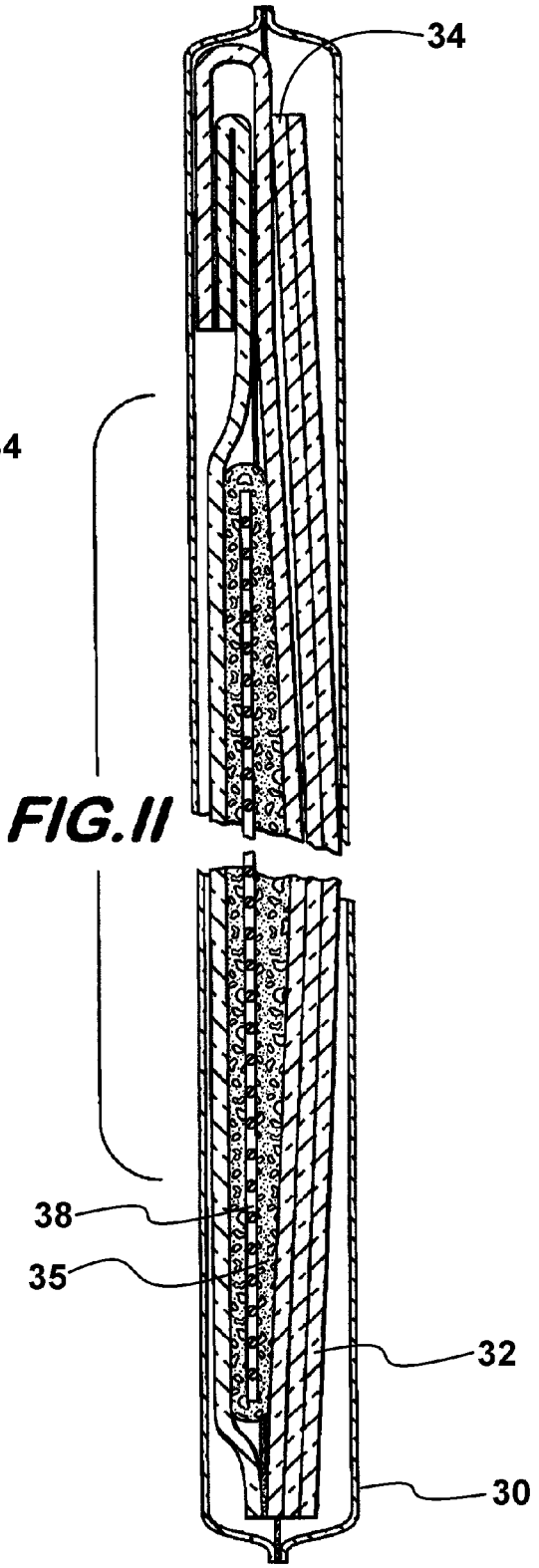
FIG. 11 is a right side sectional elevation view taken from FIG. 9 as shown in that figure.
Figure 14:
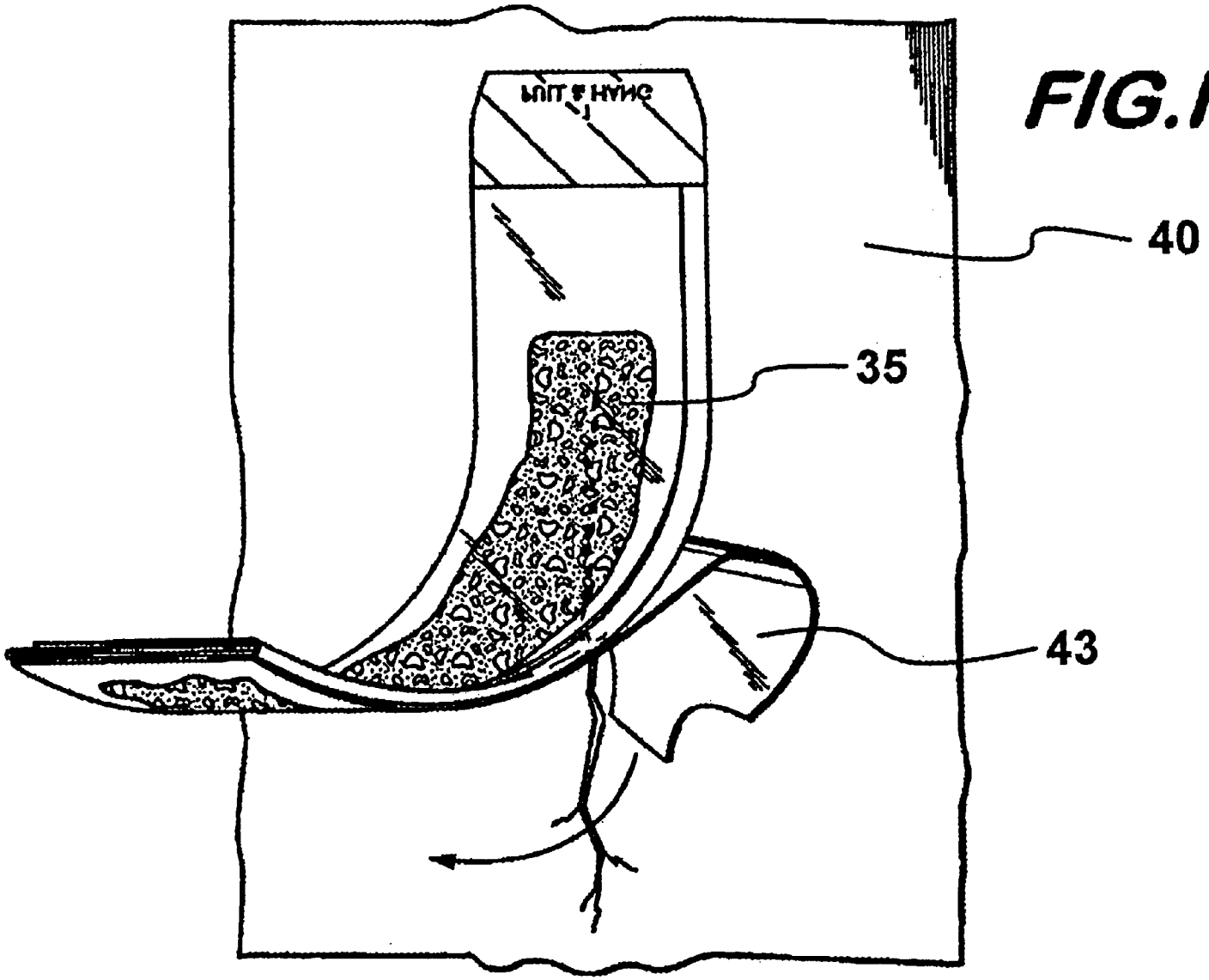
FIG. 14 is a front elevation view showing a rear half of the wrapper being removed.

Referring now to FIG. 11, a side-sectional view taken of the embodiment shown in FIGS. 9 and 10 further illustrates the outer packaging 30. The packaging provides an airtight container for the joint compound 35 that is sealed in a wrapper including a tri-fold front having an inner fold 32 and an outer fold 34. One of the major differences of this embodiment in comparison with the embodiment shown in FIGS. 1-8 is that the supporting tape or mesh patch material 38 is embedded within or behind the compound 35 and is preferably a screen-type tape or self-adhesive mesh 38 rather than a solid dry-patch utilized in the previous embodiment.

FIG. 12 is another sectional view which also shows the mesh or self-adhesive mesh patch 38 embedded within or behind the compound 35. The wrapper having a tri-fold front sheet 32 may be clearly seen as well as the employment of a rear wrapper half affixed such as by an adhesive 39 so that the compound and embedded screen patch material may stay contained. An airtight sealing is not critical in this embodiment since all elements of the invention are encased in outer packaging 30.

Figure 15:
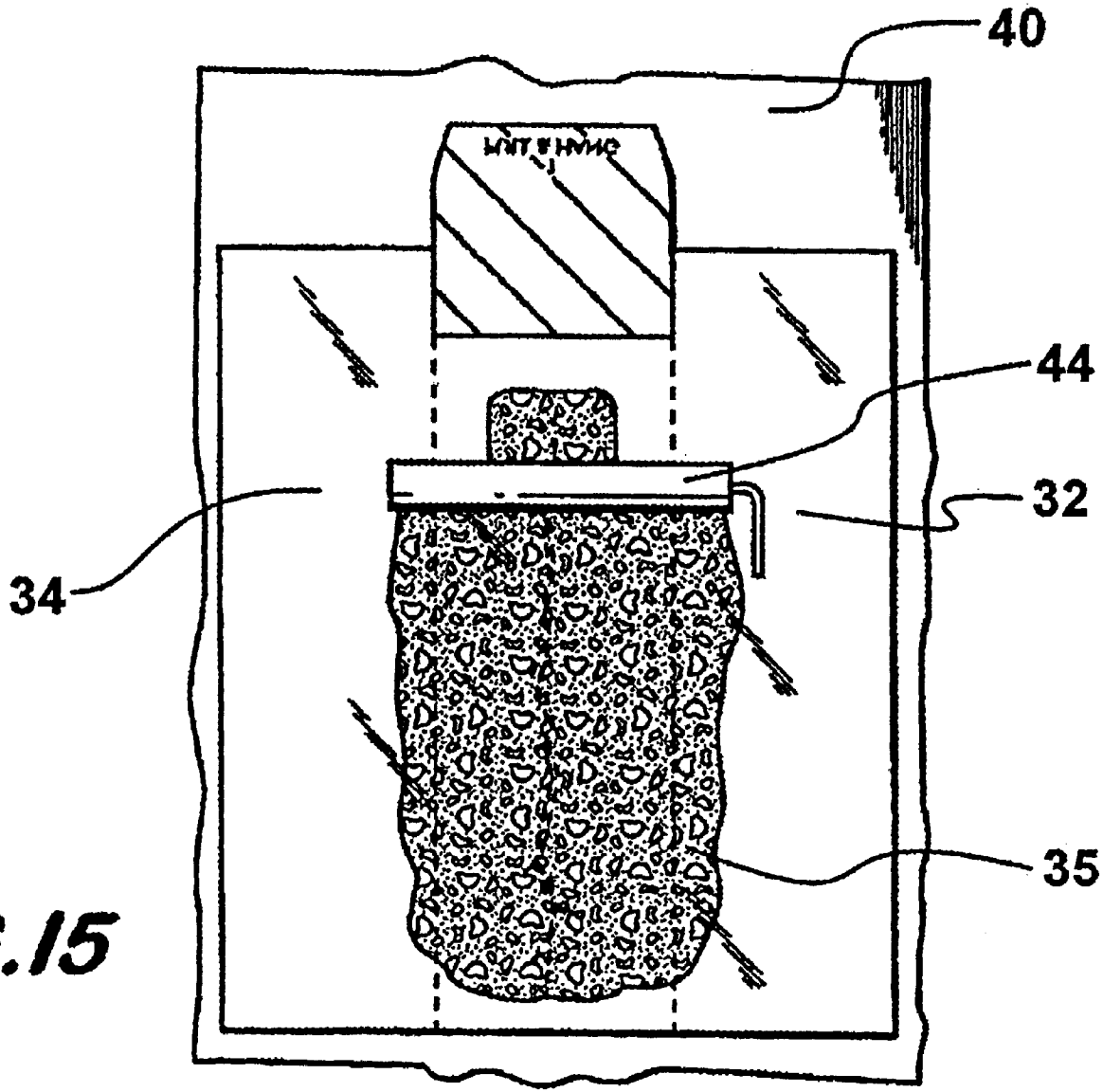
FIG. 15 is a front elevation view showing the application of a roller to the unfolded transparent front sheet showing the spreading of the settable joint compound.
Figure 16:
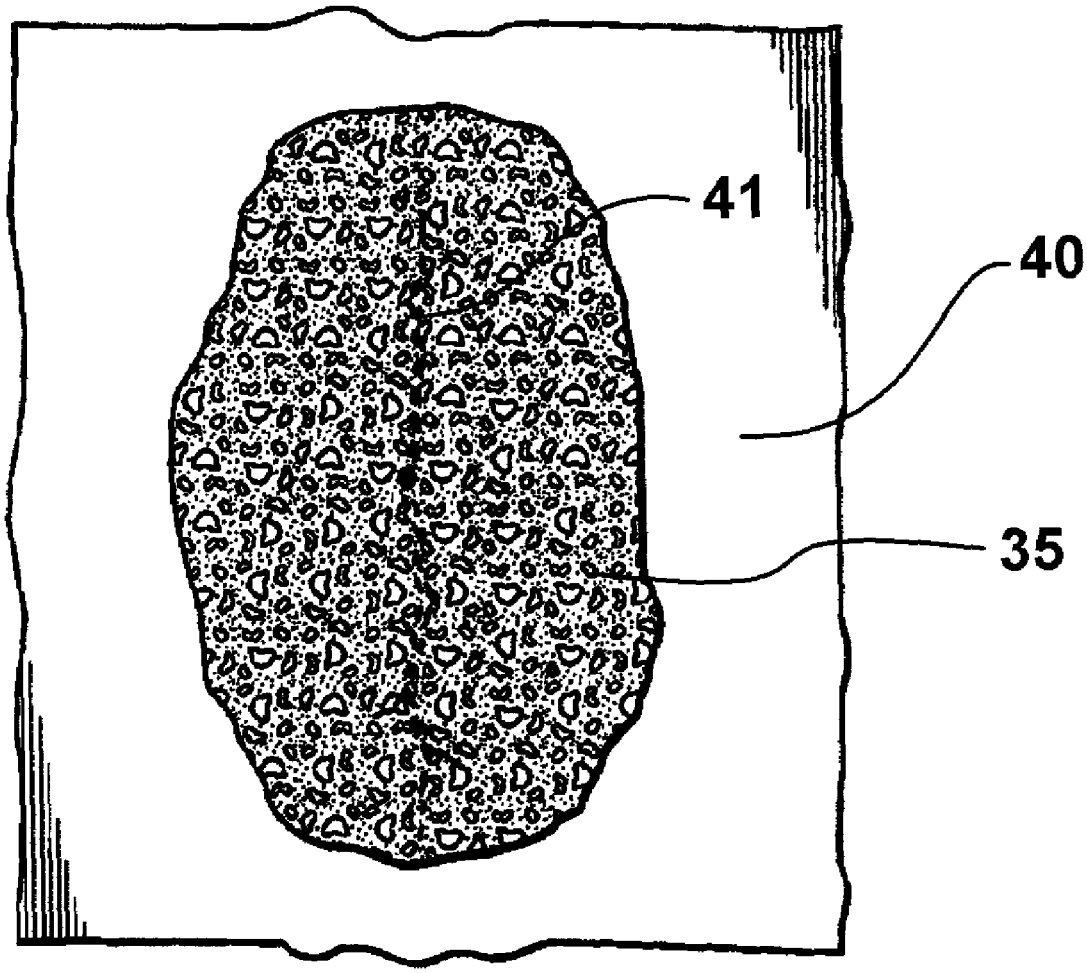
FIG. 16 is a front view showing the resulting compound covering the wall crack with the wrapper removed.

Referring now to FIGS. 13 through 16, the steps in the procedure for utilizing the alternate embodiment of FIGS. 9 through 12 are shown. Wall 40 as illustrated includes a long, vertically extending crack 41 or the primary seam between wallboard sheets. To use the invention, a back side adhesive surface 42 at one end is first exposed by peeling away covering sheet 43 in the area of adhesive 42 and then applied to the wall so that it hangs downward over the crack or edging. This is shown from a front view in FIG. 14. The rear wrapper half 43 is then fully peeled away and discarded. The compound 35 with self-adhesive tape or mesh is now exposed and may be directly applied against the wall surface 40. Next, as shown in FIG. 15, the front half of the wrapper is unfolded along the dotted lines shown so that portions 34 and 32 now lie along the wall surface. With the front wrapper opened into this position and the rear wrapper now removed, pressure may be applied against the front surface of the wrapper such as by a roller 44 to spread the compound 35 more broadly over the crack or sheet edges. Once distributed into a thin layer, the compound provides a smooth transition between the embedded patch screen and the surrounding surface of the wall 40. If the outer sheet half is transparent or translucent then progress of the spreading of the compound can be easily observed to the point where it needs no further spreading and is ready to be dried. As in the case with the previous embodiment, if a breathable wrapper material is utilized, the wrapper is dried in place, allowing surface-contour protection while assisting in drying, and then removed or, if a non-breathable material is used, the wrapper is first removed, exposing the settable compound to the air, which then may dry to the final position as shown in FIG. 16.

Thus it may be appreciated to those of skill in the art that the advantages of the invention have been achieved from the embodiments of the preferred invention shown. Also, it should be understood that there may be other modifications and changes to the present invention that will be obvious to those of skill in the art from the foregoing description, however, the present invention should be limited only by the following claims and their legal equivalents.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is:

1. A method for repairing damaged drywall, comprising:

providing a quantity of wet settable wallboard joint compound sealed between front-facing and rear-facing wrapper halves, said front-facing wrapper being a transparent waterproof microporous breathable flexible sheet;

providing a self-adhesive dry patch affixed to the outside of the front-facing wrapper;

removing the dry patch from the front-facing wrapper and applying the patch over a damaged area of wallboard to prevent the compound from entering the damaged area;

removing the front-facing wrapper from the rear-facing wrapper exposing the joint compound;

applying the joint compound directly over the patch and not into the damaged area;

smoothing said joint compound by applying pressure to the front-facing wrapper until the joint compound is evenly distributed over the patch;

observing through the front-facing wrapper the drying of the joint compound; and removing the front-facing wrapper after observing that the compound has dried.

* * * * *